US005267924A

United States Patent [19]

Miller et al.

[11] Patent Number: 5,267,924

[45] Date of Patent: Dec. 7, 1993

[54] APPARATUS AND METHOD FOR IMPARTING CONTINUOUS PASSIVE MOTION TO THE FOOT

[75] Inventors: Robert S. Miller, Blue Bell; Robert P. Wolk, Fort Washington; Guido LaPorta, Dalton, all of Pa.; Harold Schoenhaus, Cherry Hill, N.J.; William J. Covert, Berlin, N.J.; Ray M. Frey, Cherry Hill, N.J.; Semond Levitt, Huntingdon Valley, Pa.

[73] Assignee: Advanced Kinetics, Inc., Fort Washington, Pa.

[21] Appl. No.: 1,720

[22] Filed: Jan. 7, 1993

[51] Int. Cl.[5] ..... A63B 23/10

[52] U.S. Cl. ..... 482/79; 128/25 B

[58] Field of Search ..... 482/79, 80; 128/25 B

[56] References Cited

U.S. PATENT DOCUMENTS

| | | | |
|---|---|---|---|
| 1,546,506 | 7/1975 | Naysmith | 128/25 B |
| 2,041,693 | 5/1936 | Boltz et al. | 128/25 B |
| 2,250,493 | 7/1941 | Milne | 128/25 B |
| 2,397,428 | 3/1946 | Moshier | 128/25 B |
| 3,789,836 | 2/1974 | Girten . | |
| 4,558,692 | 12/1985 | Greiner . | |
| 4,635,931 | 1/1987 | Brännstam | 128/25 B |
| 4,637,379 | 1/1987 | Saringer . | |
| 4,716,889 | 1/1988 | Saringer . | |
| 4,842,265 | 6/1989 | Kirk . | |
| 4,862,875 | 9/1989 | Heaton . | |
| 4,875,469 | 10/1989 | Brook . | |
| 4,945,902 | 8/1990 | Dorer . | |
| 5,010,878 | 4/1991 | Kline . | |
| 5,094,226 | 3/1992 | Medcalf et al. | 128/25 B |
| 5,176,598 | 1/1993 | Gardner | 128/25 B |

OTHER PUBLICATIONS

"The New JACE T300 Dedicated Toe CPM From Thera-Kinetics", in Physical Therapy Products, Jul., 1992, pp. 1 and 24.

*Primary Examiner*—Richard J. Apley
*Assistant Examiner*—Lynne A. Reichard
*Attorney, Agent, or Firm*—William H. Eilberg

[57] ABSTRACT

A continuous passive motion (CPM) device includes a foot support plate and a toe plate. The foot support plate pivots back and forth, driven by a rod connected to a motor. A toe plate pivots separately from the foot support plate, and receives its motive power solely from the foot support plate. The engagement of a pair of pins, one pin connected to the foot support plate and the other pin connected to the toe plate, causes the toe plate to pivot at the desired moment. The toe plate pivots in the opposite direction from that of the foot support plate, and pivots only when the foot support plate reaches a predetermined angle. At other times, the toe plate does not move. The latter arrangement enhances the level of comfort felt by the patient, by increasing the effective angle of flexing of the foot, while limiting the amount of flexing of the heel to a comfortable level. The positioning of the pins determines through how many degrees the toe plate pivots for each degree of rotation of the foot support plate.

32 Claims, 4 Drawing Sheets

APPARATUS AND METHOD FOR IMPARTING CONTINUOUS PASSIVE MOTION TO THE FOOT

BACKGROUND OF THE INVENTION

This invention relates to the field of physical therapy, and provides an apparatus and method for exercising the joints of the human foot following injury or surgery.

Conventional medical doctrine formerly taught that one should immobilize a joint following injury or surgery, to allow the joint to heal properly. More recently, physicians have recognized that doing just the opposite will cause a joint to heal more quickly and more completely. The term "continuous passive motion", also called "CPM", denotes the method whereby the joint undergoes continuous, artificially-induced, rhythmic movements, for the purpose of rehabilitation of the joint. Instead of holding a joint (such as a knee, an elbow, a finger joint, or a toe) immobile in a cast, one keeps the joint in slow, continuous, constrained motion. Medical practitioners have found that CPM overcomes the tendency of muscle to degenerate. One can effectively use CPM very soon after an accident or operation, and can thus maintain freedom of movement of the joint well before the muscle has regained the ability to function by itself.

Various patents show CPM devices of the prior art. For example, U.S. Pat. No. 5,010,878 shows a device specifically designed to impart continuous passive motion to the toes. In the patented device, a rod attaches to the patient's toes and moves them back and forth.

U.S. Pat. No. 4,862,875 shows another device which provides CPM for the foot, and which has separate means for lifting the toes.

Other examples of CPM devices, not necessarily directed to the toes, appear in U.S. Pat. Nos. 4,875,469, 4,716,889, 4,945,902, 4,637,379, 4,842,265, 4,558,692, and 3,789,836.

Experience in the field of toe CPM has shown that, for best results, the heel should flex at least about 40° relative to the toes. While this amount of flexing provides the best therapy, it also creates substantial discomfort for the patient. Moreover, most of the toe CPM devices of the prior art do not move the heel at all, but instead move the toes only. With toe motion only, the task of generating a rotation of 40° becomes difficult and uncomfortable for the patient.

More significantly, the devices of the prior art, which move the toes only, do not move the toes in an anatomically correct path. Some such devices tend to allow the toe to move from side to side, while flexing the joint. Other devices aim to move the toe joint in a circular motion, simulating the natural movements of the joint. But, in practice, the toe joint does not move in a perfectly circular path. By moving the joint in an exactly circular path, one does not replicate normal conditions of movement of the joint.

The present invention represents an improvement over the prior art, in that it provides both heel and toe movement, and generates the relative flexing required for proper therapy, while maintaining a high level of comfort for the patient. The present invention moves the toe joint in an anatomically correct path, which closely simulates the movements experienced during normal walking.

The invention includes an apparatus which precisely regulates the travel of a toe plate, in relation to the movement of the foot support plate. By appropriate selection of design parameters, one can insure that the toe plate will flex at exactly the right moment to produce the desired amount of flexing. The patient can control the maximum angles of movement and the speed of the device by using suitable controls mounted on the housing for the CPM device.

SUMMARY OF THE INVENTION

The CPM device of the present invention includes a foot support plate and a toe plate, both mounted for pivoting motion within a frame. The two plates pivot about different pivot points. A source of oscillatory motion moves the foot support plate directly. The foot support plate moves back and forth continuously, through predetermined angles. The toe plate moves only upon engagement of a pair of pins connected respectively to the foot support plate and the toe plate. Thus, the toe plate receives its motive power only from the foot support plate.

When the heel portion of the foot support plate has moved upward through a predetermined angle, the pins engage, and the toe plate pivots in the opposite rotational direction from that of the foot support plate. The relative positioning of the pins causes the toe plate to pivot through two degrees for every one degree of rotation of the foot support plate. The pivoting of both the foot support plate and the toe plate increases the effective angle of flexing, while maintaining a high level of patient comfort.

As the heel portion of the foot support plate moves downward, a spring returns the toe plate to its initial position. The foot support plate then continues to pivot in the same direction, with the heel portion moving downward, but a stop prevents the toe plate from deviating from its initial position. Thus, the toe plate pivots only during the final portion of upward movement of the heel portion of the foot support plate.

The CPM device of the present invention can also include a housing which holds a strip chart recorder, so that the patient can obtain a written record of the amount and nature of the therapy. The housing can also provide a mounting means for a set of controls which the patient may operate to regulate the speed and angle of the motion imparted to the heel and toes.

The method of the present invention therefore resides in the concept of rotating a separately pivotable toe plate in the opposite direction from that of a foot support plate, the toe plate moving only during the final portion of upward travel of the foot support plate. An important feature of this method resides in the fact that when the toe plate pivots, it pivots at an angular rate having a predetermined relationship to the rate of angular movement of the foot support plate. In the preferred embodiment, when the toe plate pivots, it moves at an angular rate twice that of the foot support plate.

In an alternative embodiment, the toe plate does not move, and the only motion occurs in the foot support plate. In this embodiment, movement of the patient's heel alone causes flexing of the toe joint, due to the placement of the toe joint and toes on the separate, stationary foot support plate.

The present invention therefore has the primary object of providing a continuous passive motion (CPM) device for exercising the human toes.

The present invention has the further object of providing a CPM device for the toes, wherein a toe plate moves only in response to motion of a foot support plate.

The present invention has the further object of providing a CPM device wherein the toe plate moves at an angular rate which exceeds that of the angular rate of movement of the foot support plate.

The invention has the further object of improving the efficiency of CPM therapy applied to the toes.

The invention has the further object of providing a CPM device which increases the effective amount of flexing of the foot, while maintaining a high level of patient comfort.

The person skilled in the art will recognize other objects and advantages of the present invention, from a reading of the following brief description of the drawings, the detailed description of the invention, and the appended claims.

DETAILED DESCRIPTION OF THE INVENTION

Figure 1:
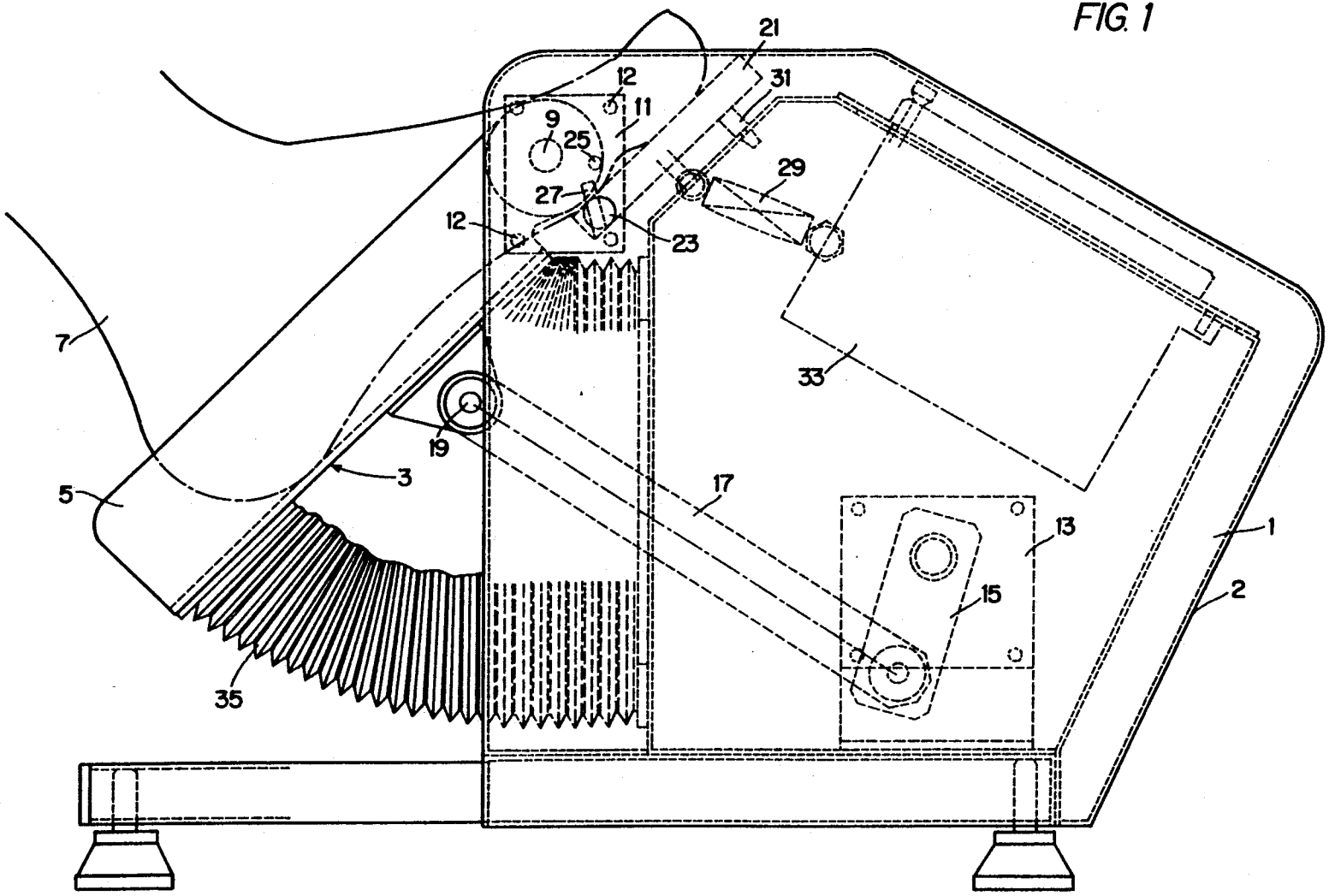
FIG. 1 provides a side elevational view, partly broken away, showing the essential components of the CPM device of the present invention.

FIG. 1 shows the basic structure of the CPM device of the present invention. Frame 1 supports the CPM device, and supports a cover 2 which shields the interior components of the device from the outside. Because of the presence of the cover, Figure I shows the interior components in dotted outline. Foot support plate 3 has two parallel side walls, though one can see only side wall 5 in the figure. Thus, the foot support plate defines a generally U-shaped channel, within which foot 7 rests.

The foot support plate pivots about pivot shaft 9 which connects to pivot support plate 11, mounted to the frame by bolts 12. Thus, the foot support plate has a firm connection to the frame, while remaining free to pivot about the pivot point defined by the center of the shaft 9. Due to the position of shaft 9, the foot support plate pivots about a point centered about the ball joint of the patient's large toe.

Motor 13 provides oscillatory movement which drives the foot support plate. The motor can comprise a gear motor having a variable output speed. However, one can use any other motor capable of providing the required oscillatory movement, and the invention includes all such alternatives. The motor moves crank arm 15 back and forth (from side to side in FIG. 1). Connecting rod 17 connects the crank arm with clevis 19, connected to foot support plate 3.

Toe plate 21 comprises a generally flat member and pivots about pivot shaft 23, also connected to pivot support plate 11. Thus, the device provides a rigid connection of the toe plate with the frame, while allowing the toe plate to pivot freely about shaft 23.

The foot support plate 3 includes driver pin 25, rigidly connected to the foot support plate and extending laterally outward therefrom. The driver pin 25 has the purpose of selectively engaging driven pin 27 which has a rigid connection to the toe plate 21 and which extends upward therefrom, as shown. Due to the pivoting motion of the foot support plate 3, driver pin 25 moves along a circular arc having a radius equal to the distance between the center of pivot shaft 9 and the driver pin. As the foot support plate rotates in the clockwise direction (with the heel portion of the foot support plate moving upward, as shown in FIG. 1), the driver pin also moves clockwise, and eventually engages driven pin 27. Only when these two pins engage will the toe plate begin to pivot, and in the counterclockwise direction. The toe plate pivots against the force of spring 29 which tends to urge the toe plate towards the frame.

When the foot support plate moves in the opposite direction, namely counterclockwise, the driver pin and driven pin eventually disengage. The toe plate returns to its initial position, due to the action of the spring. Rubber stop 31 prevents the toe plate from rotating clockwise beyond its initial position. Thus, as the foot support plate continues to rotate counterclockwise, the pins remain disengaged, and the toe plate does not rotate. A more detailed analysis of the motion of the foot support plate and toe plate appears later.

FIG. 1 also shows strip chart recorder 33, which one can conveniently mount to the frame, as shown. The recorder provides a written record of the nature and extent of the therapy. The recorder receives, as its input, an analog signal generated by a potentiometer (not shown) turned preferably by shaft 9. One could also use one of the other moving parts of the device to generate the analog signal. One could also use other means of generating the analog signal for the chart recorder.

Bellows 35 serves to cover the interior components of the CPM device, thus preventing the accidental insertion of hands into the area of its moving parts. While a bellows constitutes the preferred means of shielding the moving parts from the outside, one can use other shielding structures, within the scope of the invention.

FIGS. 2 through 7 illustrate the various positions of the major components of the CPM device, during a complete cycle of operation. Before explaining these figures, one should first understand the terminology used in describing the motions shown in these figures.

Figure 2:
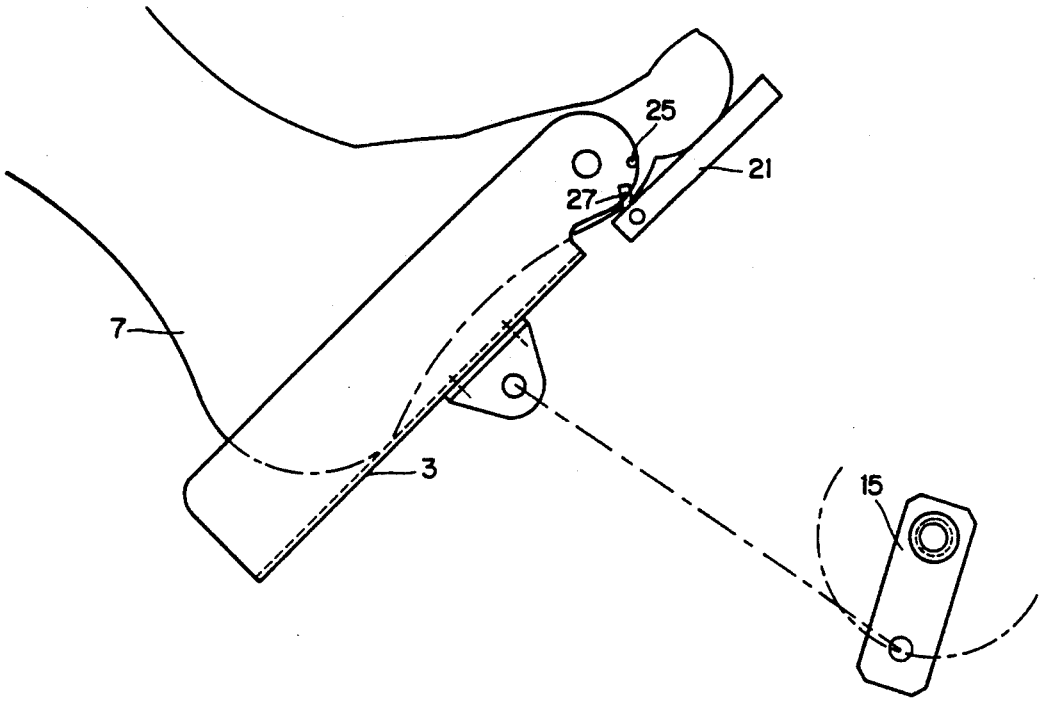
FIGS. 2–7 show simplified views of the CPM device, with the foot support plate and toe plate, assuming various positions, these figures thereby showing a complete cycle of operation of the device of the present invention.

FIG. 2 illustrates the "base position", wherein the foot support plate 3 and the toe plate 21 both lie along the same line (or, equivalently, wherein both make the same angle with the horizontal). In the base position, the foot support plate preferably makes an angle of about 45° with the floor. When the heel portion of the foot support plate moves upward, as shown, for example, in FIG. 3, one calls the angle formed by the foot support plate, relative to the base position, the "dorsi" angle. A positive dorsi angle implies that the heel portion of the foot support plate has moved upward, above the base position. Conversely, when the heel portion of the foot support plate moves downward from the base position, as shown, for example, in FIG. 7, one calls the angle formed by the foot support plate, relative to the base position, the "plantar" angle. A positive plantar angle means that the heel portion of the foot support plate has moved downward, below the base position.

Figure 3:
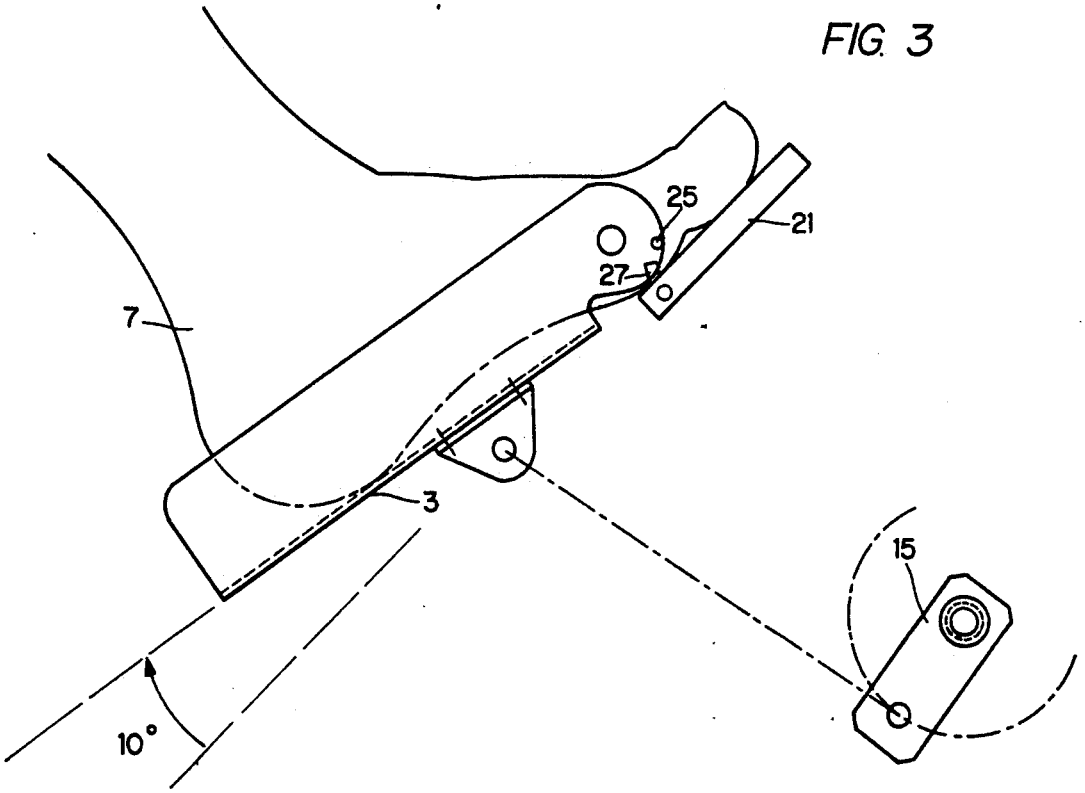

Now consider the movements represented by FIGS. 2–7. In FIG. 2, foot support plate 3 starts in the base position. As controlled by the motor, crank arm 15 rotates clockwise, so that the foot support plate also rotates clockwise. As shown in FIG. 3, the foot support plate has passed through a 10° dorsi angle. In other words, the foot support plate makes an angle of 10° with the base position. Because driver pin 25 has not yet engaged driven pin 27, toe plate 21 does not rotate.

Thus, FIG. 3 shows the toe plate in the same position as in FIG. 2.

Figure 4:
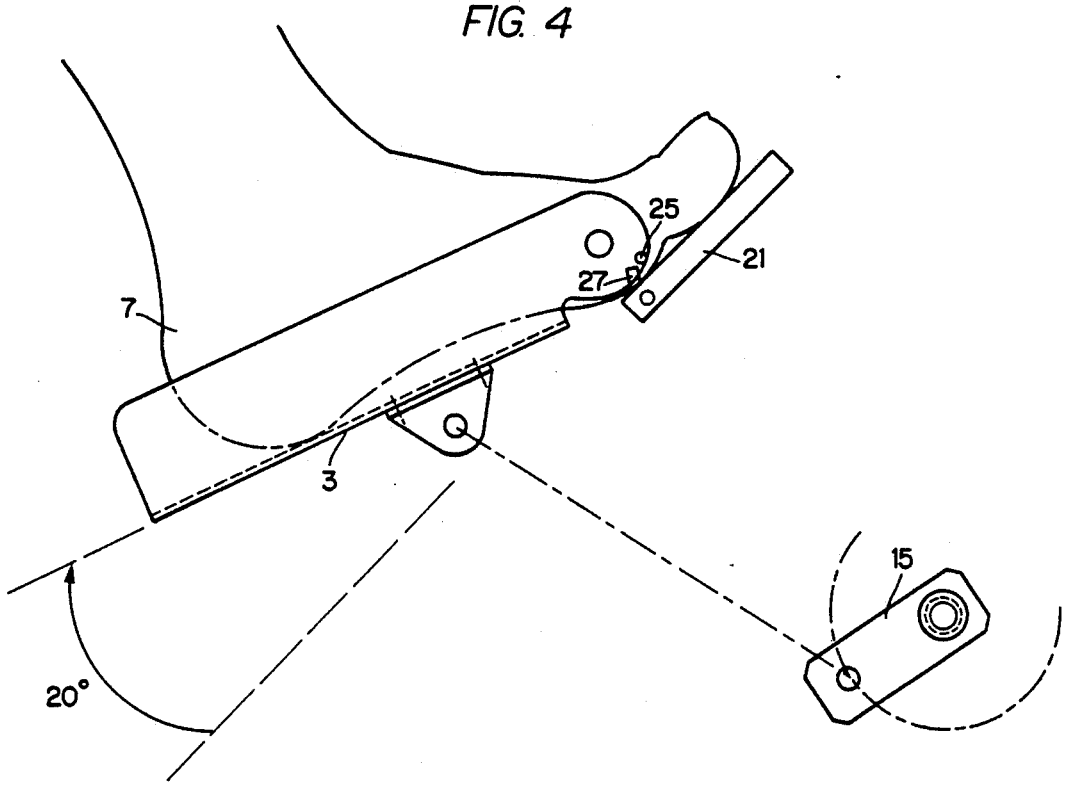

In FIG. 4, crank arm 15 has moved farther, and foot support plate 3 has moved through a 20° dorsi angle. At this instant, the pins 25 and 27, though they are closer than before, still have not yet engaged, and the toe plate remains in its original position. In the example illustrated in the figures, the pins do not touch until the foot support plate reaches the dorsi angle of 25° (not shown).

Figure 5:
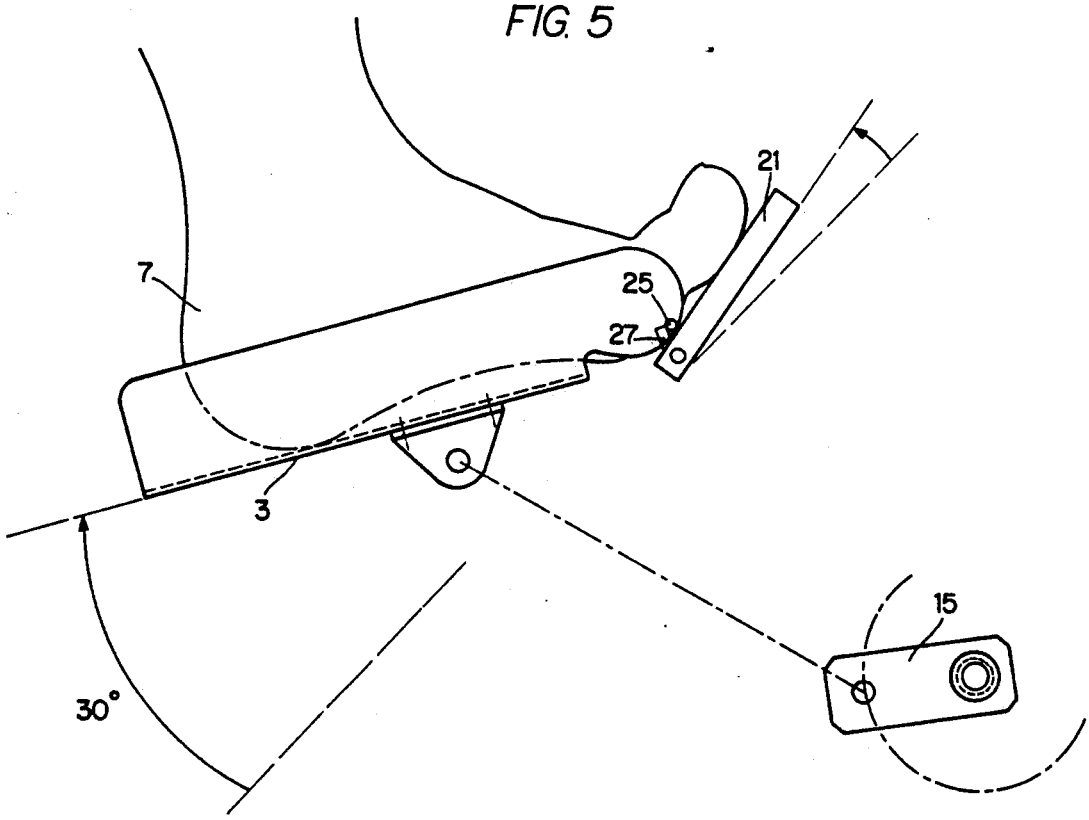

In FIG. 5, the crank arm has moved the foot support plate to a dorsi angle of 30°. The pins 25 and 27 have engaged just before the moment represented in FIG. 5, and the toe plate has begun to move. One chooses the positions of the pins 25 and 27 such that the toe plate moves through two degrees for every one degree of movement of the foot support plate. Thus, in FIG. 5, since the toe plate began to move when the foot support plate reached the dorsi angle of 25°, the toe plate has moved through 10° (2×(30–25)). In the example shown, the foot support plate moves through a maximum dorsi angle of 30°.

Figure 6:
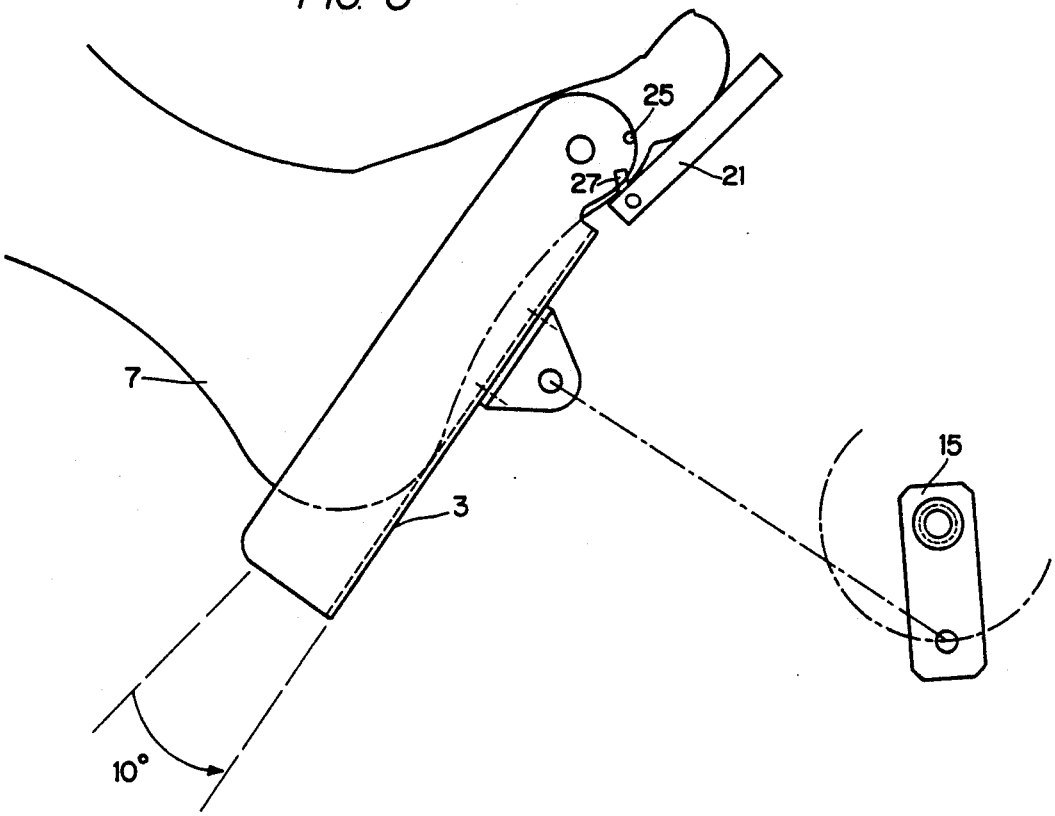

FIG. 6 shows the position wherein crank arm 15 has moved counterclockwise, pulling the foot support plate back through the base position and to a plantar angle of 10°. The spring 29 (not shown in FIGS. 2–7 but illustrated in FIG. 1) has pulled the toe plate back to its initial position, where the rubber stop (also shown only in FIG. 1) holds the toe plate in this position. Note that the pins 25 and 27 do not touch, and have no effect on the movement of the toe plate during this portion of the operating cycle. The toe plate thus remains in its initial position.

Figure 7:
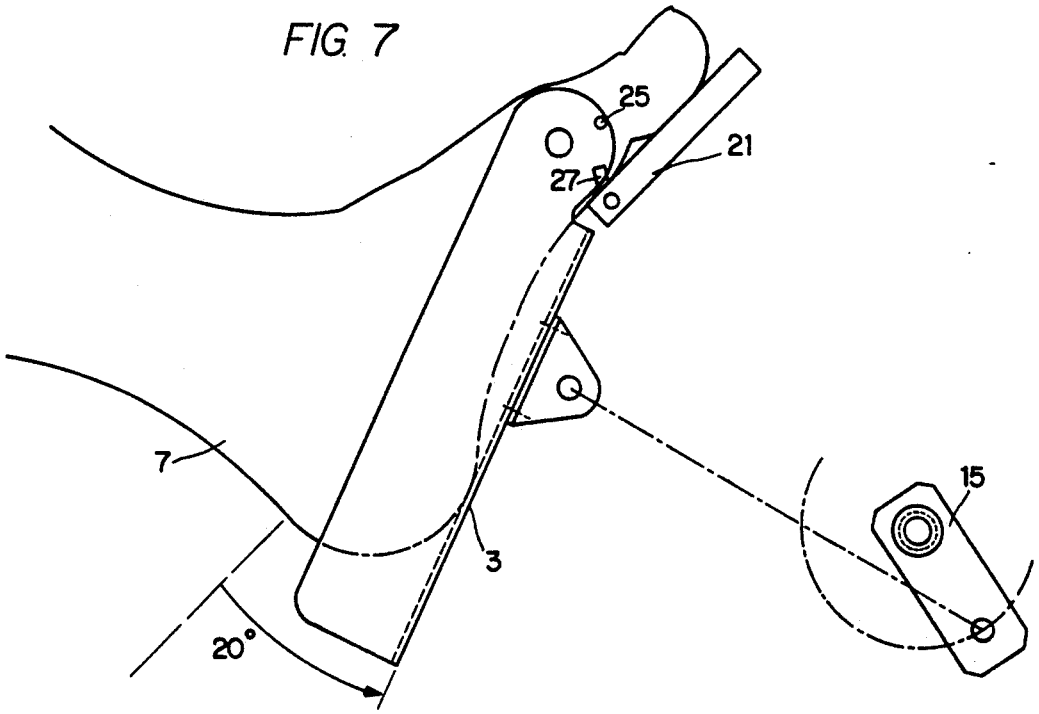

In FIG. 7, the crank arm has pulled the foot support plate to a plantar angle of 20°. Again, the toe plate remains in the initial position for the same reasons given above.

The choice of position of the driver pin 25 and the driven pin 27 determines the relative angular movement of the toe plate and the foot support plate. In the example shown in the figures, the radial distance between the center of pivot shaft 9 and driver pin 25 is twice the distance from the contact point between the pins and the center of toe plate pivot shaft 23. In general, the ratio of the radial distance between the shaft 9 and the pin 25, and the distance between the contact point of the pins and the center of shaft 23, equals the number of degrees through which the toe plate will rotate for every degree of rotation of the foot support plate. In the present example, which represents the preferred embodiment, this ratio equals two. Clearly, one could change the ratio by adjusting the position of driver pin 25 with respect to driven pin 27, as required.

Also, by moving the driver pin 25 along the circumference of a circle having the radius chosen as described above, one can determine the point at which the pins come into contact. Thus, one can determine at what point the toe plate will begin to move, relative to the movement of the foot support plate. In the example given, the toe plate does not begin to move until the foot support plate has reached a dorsi angle of 25°. Other positions of the pins would produce a device in which the toe plate begins to move earlier or later.

The relative positioning of the pins normally constitutes a permanent feature of the CPM device, and in the preferred embodiment shown, the patient cannot change the positions of the pins. One would not expect the patient to need to make such adjustments. However, if necessary, one can modify the device to provide removable and repositionable pins, and the present invention includes such possible modification.

One can house the components of the CPM device in an appropriate box, so that the entire device becomes portable. The box can also provide a mounting for controls used by the patient. For example, the patient can control the maximum angles for dorsi and plantar travel, and can also control the speed of the motor. Note that, for the construction shown, wherein the pins 25 and 27 do not engage until the foot support plate has reached a dorsi angle of 25°, the toe plate will not move at all if the patient sets the maximum dorsi angle to 25° or less. As noted above, the box can also contain a strip chart recorder. Alternatively, one can provide a strip chart recorder separately from the housing of the CPM device. One can also provide a hand-held remote control device (not shown) so that the patient can control the device without touching the device itself.

The maximum angles of travel discussed above represent examples only, and one should not interpret them as limiting the invention. One can vary these maximum angles. For example, one can design a system having a maximum dorsi travel of the foot support plate of 40°. By selection of the positions of the pins, one can also choose when to begin the motion of the toe plate. For example, the toe plate could begin to move when the foot support plate reaches 30°, or 35°, or some other angle. However, the embodiment illustrated represents the preferred embodiment.

The major advantage of the present invention resides in its ability to provide effective flexing of up to 40° or more, while maintaining a high degree of comfort for the patient. When the foot support plate has traveled through a dorsi angle of, say, 30°, and the toe plate has rotated through an angle of 10°, the effective amount of flexing equals the sum of these rotations, namely 40°. However, by limiting the angle of rotation of the heel to 30°, one achieves a much greater level of comfort in comparison to the case wherein the foot support plate moves through 40° and the toe plate does not move.

The present invention also has the advantage that it moves the toe joint in a manner which closely simulates actual movement of the joint during walking. Thus, the invention promotes proper healing of the joint while also maintaining the comfort for the patient.

In another embodiment of the invention, one can permit the foot support plate to move, while keeping the toe plate stationary at all times. This embodiment would resemble the illustrated device, except that one would omit one or both pins, thereby preventing the toe plate from pivoting. The important feature resides in the movement of the foot support plate, so that movement of the heel alone causes the toe joint to flex. The toe joint would still flex, in this embodiment, because the toe itself would rest on a stationary and separate toe plate, while the heel pivots upward and downward on the foot support plate.

While the specification has described the invention with respect to a specific embodiment, one can modify the invention in many ways. For example, the particular type of motor used can vary. The number and nature of the controls operated by the patient can also vary. One can build the device without the strip chart recorder. One should consider these and other similar variations as within the spirit and scope of the following claims.

What is claimed is:

1. An apparatus for imparting continuous passive motion to a foot, the apparatus comprising:

a) a frame, b) a foot support plate, the foot support plate being mounted to the frame and being capable of pivoting motion about a first pivot point, c) means for moving the foot support plate back and forth about the first pivot point, d) a toe plate, the toe plate also being mounted to the frame and being capable of pivoting motion about a second pivot point, the second pivot point being distinct from the first pivot point, the toe plate being free of any permanent connection with the foot support plate, and e) means for inducing pivoting movement of the toe plate in response to pivoting movement of the foot support plate, wherein the toe plate pivots during some, but not all, of the movement of the foot support plate.

2. The apparatus of claim 1, wherein the inducing means comprises means for causing the toe plate to pivot through two degrees for every one degree of rotation of the foot support plate, when the toe plate pivots.

3. The apparatus of claim 1, wherein the inducing means comprises means for determining the angle through which the toe plate pivots when the foot support plate rotates through a given angle.

4. The apparatus of claim 3, wherein the moving means includes a motor connected to the foot support plate by a connecting rod, the motor comprising means for imparting oscillatory movement to the connecting rod.

5. The apparatus of claim 3, wherein at least a portion of the connecting rod is located within a region that is enclosed by a bellows, the bellows being attached to the foot support plate and to the frame.

6. The apparatus of claim 3, wherein the toe plate can pivot from an initial position, and wherein the apparatus further comprises spring means for returning the toe plate to the initial position.

7. The apparatus of claim 6, wherein the spring means comprises a spring connected to the toe plate and to the frame, and wherein the toe plate is connected to a stop which is positioned to be urged against the frame when the toe plate is pulled by the spring.

8. The apparatus of claim 7, further comprising a strip chart recorder, mounted to the frame, the strip chart recorder comprising means for recording the movements of the foot support plate.

9. An apparatus for imparting continuous passive motion to a foot, the apparatus comprising a foot support plate and a toe plate, the foot support plate and toe plate both being pivotable, the toe plate being free of any permanent connection with the foot support plate, means for imparting pivoting motion to the foot support plate, and engagement means for inducing pivoting motion of the toe plate in response to pivoting motion of the foot support plate, wherein the toe plate is pivoted solely by movement imparted by the foot support plate.

10. The apparatus of claim 9, wherein the engagement means comprises means for pivoting the toe plate during some, but not all, of the time that the foot support plate is pivoting.

11. The apparatus of claim 9, wherein the engagement means comprises means for determining the angle through which the toe plate pivots when the foot support plate pivots through a given angle.

12. The apparatus of claim 11 wherein the engagement means comprises means for pivoting the toe plate through two degrees for every one degree of rotation of the foot support plate, when the engagement means causes pivoting motion of the toe plate.

13. The apparatus of claim 11, wherein the engagement means for returning the toe plate to an initial position after the toe plate has been pivoted by the engagement means.

14. The apparatus of claim 11, wherein the means for imparting pivoting motion to the foot support plate comprises a motor connected to a crank, the crank being connected to a connecting rod which is affixed to the foot support plate.

15. An apparatus for imparting continuous passive motion to a foot, the apparatus comprising a foot support plate and a toe plate, the foot support plate and toe plate being distinct from each other, the toe plate being free of any permanent connection with the foot support plate, and means for imparting pivoting motion to the foot support plate, so that the heel of a patient's foot moves upward and downward, under the influence of the imparting means, wherein the imparting means comprises means for flexing the toe joint of the patient.

16. A method of providing continuous passive motion to a foot, the method comprising the steps of:

a) pivoting a foot support plate back and forth about a first pivot point, from a base angle to a maximum dorsi angle, then back to the base angle, then to a maximum plantar angle, then back to the base angle, the latter motion being repeated continuously, and b) moving a toe plate about a second pivot point, the toe plate being distinct from the foot support plate, wherein the toe plate is pivoted from a first position to a second position only when the foot support plate has passed through a predetermined dorsi angle, and wherein the toe plate is returned to the first position when the foot support plate returns to the base angle, and wherein the toe plate remains in the first position when the foot support plate is moved through the plantar angle.

17. The method of claim 16, wherein the toe plate, when it pivots, pivots through two degrees for every one degree of rotation of the foot support plate.

18. The method of claim 16, wherein the toe plate, when it pivots, pivots through a predetermined angle for every degree of rotation of the foot support plate.

19. The method of claim 16, wherein the toe plate is returned to the first position under the influence of a spring.

20. A method of imparting continuous passive motion to a patient's foot, the method comprising the steps of:

a) placing the patient's foot on a foot support plate and a toe plate, such that the heel of the foot rests on the foot support plate and the toes rest on a toe plate, the foot support plate and the toe plate being distinct from each other, the toe plate being free of any permanent connection with the foot support plate, and b) moving the foot support plate back and forth, so that the heel of the patient's foot moves upward and downward, and wherein the patient's toe joint flexes due to the upward and downward movement of the foot support plate.

21. An apparatus for imparting continuous passive motion to a foot, the apparatus comprising:

a) a frame, b) a foot support plate, the foot support plate being mounted to the frame and being capable of pivoting motion about a first pivot point, c) means for moving the foot support plate back and forth about the first pivot point, d) a toe plate, the toe plate also being mounted to the frame and being capable of pivoting motion about a second pivot point, the second pivot point being distinct from the first pivot point, and e) means for inducing pivoting movement of the toe plate in response to pivoting movement of the foot support plate, wherein the toe plate pivots during some, but not all, of the movement of the foot support plate, wherein the inducing means comprises means for determining the angle through which the toe plate pivots when the foot support plate rotates through a given angle.

22. The apparatus of claim 21, wherein the moving means includes a motor connected to the foot support plate by a connecting rod, the motor comprising means for imparting oscillatory movement to the connecting rod.

23. The apparatus of claim 21, wherein at least a portion of the connecting rod is located within a region that is enclosed by a bellows, the bellows being attached to the foot support plate and to the frame.

24. The apparatus of claim 21, wherein the toe plate can pivot from an initial position, and wherein the apparatus further comprises spring means for returning the toe plate to the initial position.

25. The apparatus of claim 24, wherein the spring means comprises a spring connected to the toe plate and to the frame, and wherein the toe plate is connected to a stop which is positioned to be urged against the frame when the toe plate is pulled by the spring.

26. The apparatus of claim 25, further comprising a strip chart recorder, mounted to the frame, the strip chart recorder comprising means for recording the movements of the foot support plate.

27. An apparatus for imparting continuous passive motion to a foot, the apparatus comprising a foot support plate and a toe plate, the foot support plate and toe plate both being pivotable, means for imparting pivoting motion to the foot support plate, and engagement means for inducing pivoting motion of the toe plate in response to pivoting motion of the foot support plate, wherein the toe plate is pivoted solely by movement imparted by the foot support plate, and wherein the engagement means comprises means for determining the angle through which the toe plate pivots when the foot support plate pivots through a given angle.

28. The apparatus of claim 27, wherein the determining means comprises means for pivoting the toe plate through two degrees for every one degree of rotation of the foot support plate, when the engagement means causes pivoting motion of the toe plate.

29. The apparatus of claim 27, further comprising spring means for returning the toe plate to an initial position after the toe plate has been pivoted by the engagement means.

30. The apparatus of claim 27, wherein the means for imparting pivoting motion to the foot support plate comprises a motor connected to a crank, the crank being connected to a connecting rod which is affixed to the foot support plate.

31. An apparatus for imparting continuous passive motion to a foot, the apparatus comprising:

a) a frame, b) a foot support plate, the foot support plate being mounted to the frame and being capable of pivoting motion about a first pivot point, c) means for moving the foot support plate back and forth about the first pivot point, d) a toe plate, the toe plate also being mounted to the frame and being capable of pivoting motion about a second pivot point, the second pivot point being distinct from the first pivot point, and e) means for inducing pivoting movement of the toe plate in response to pivoting movement of the foot support plate, wherein the toe plate pivots during some, but not all, of the movement of the foot support plate, wherein the foot support plate has a longitudinal axis, and wherein the first and second pivot points are located at substantially the same position along the longitudinal axis of the foot support plate.

32. An apparatus for imparting continuous passive motion to a foot, the apparatus comprising a foot support plate and a toe plate, the foot support plate having a longitudinal axis, the foot support plate being mounted in a frame for pivoting motion about a first pivot point, the toe plate being mounted in the frame for pivoting motion about a second pivot point, the first and second pivot points being distinct and being located at substantially the same position along the longitudinal axis of the foot support plate, means for imparting pivoting motion to the foot support plate, and engagement means for inducing pivoting motion of the toe plate in response to pivoting motion of the foot support plate, wherein the toe plate is pivoted solely by movement imparted by the foot support plate.

* * * * *